United States Patent [19]

Longnecker

[11] 4,333,396

[45] Jun. 8, 1982

[54] TWO-STAGE CAN CRUSHER

[76] Inventor: Russell D. Longnecker, P.O. Box 731, Mt. Vernon, Wash. 98273

[21] Appl. No.: 137,515

[22] Filed: Apr. 4, 1980

[51] Int. Cl.[3] ..... B30B 9/32

[52] U.S. Cl. ..... 100/233; 100/266; 100/293; 100/295; 100/271; 100/902

[58] Field of Search ..... 100/DIG. 2, 266, 270, 100/271, 272, 293, 295, 237, 233, 193

[56] References Cited

U.S. PATENT DOCUMENTS

| | | | |
|---|---|---|---|
| 2,466,907 | 4/1949 | Nadolny | 100/233 X |
| 2,905,079 | 9/1959 | Brock | 100/DIG. 2 |
| 3,299,802 | 1/1967 | Black | 100/233 |
| 3,667,386 | 6/1972 | Workman | 100/DIG. 2 |
| 3,732,804 | 5/1973 | Moller | 100/DIG. 2 |
| 3,766,849 | 10/1973 | Maron | 100/DIG. 2 |
| 3,776,129 | 12/1973 | Carlson | 100/DIG. 2 |
| 3,780,647 | 12/1973 | Reimers | 100/DIG. 2 |
| 3,889,587 | 6/1975 | Wharton | 100/DIG. 2 |
| 3,948,164 | 4/1976 | Pobuda | 100/DIG. 2 |
| 4,133,261 | 1/1979 | Belfils | 100/DIG. 2 |

*Primary Examiner*—Billy J. Wilhite

*Attorney, Agent, or Firm*—David L. Garrison; Ford E. Smith

[57] ABSTRACT

An apparatus is disclosed for a two-stage crushing of empty cans along their longitudinal axes to collapse them to minimum bulk. The apparatus has a stanchion fixed to a base and long and short lever arms pivotally mounted on the stanchion. A pivotal linkage interconnects the long lever arm with the short lever arm. First and second crush heads are pivotally mounted between the base and the long and short lever arms with a pantograph type linkage to control the attitude of the crush heads.

In the first stage of crushing, the can is placed between the first of the crush heads and the base, and the long lever arm is moved toward the base to partially crush the can axially. In the second stage, the partially collapsed can is placed between the base and the second crush head. The long lever arm is moved toward the base thereby moving the short lever arm toward the base and the can is thereby completely axially crushed.

14 Claims, 6 Drawing Figures

TWO-STAGE CAN CRUSHER

BACKGROUND OF THE INVENTION

1. Field of the Invention

This invention is in the field of container crushing devices and, more particularly, relates to the crushing of thin-walled cans, such as metallic beverage cans, to reduce their bulk for recycling.

2. Description of the Prior Art

Ours is a society which uses great quantities of food and beverage containers in the form of sturdy, thin-walled cans. These cans are part of a present and growing refuse problem in that their discarded bulk without crushing can be as great as their original bulk. In addition, many of the containers are made of aluminum which degrades very slowly in the environment.

To reduce the bulk of cans and to reduce the handling and storage problems of refuse or recycling activities created in part by the bulk of cans, prior art devices are known which crush or flatten cans. Among the known prior devices are those shown in the following U.S. Pat. Nos.:

| | | | |
|---|---|---|---|
| Nadolny | 2,466,907 | Maron | 3,766,849 |
| Brock | 2,905,079 | Carlson | 3,776,129 |
| Black | 3,299,802 | Reimers | 3,780,647 |
| Workman | 3,667,386 | Wharton | 3,889,587 |
| Moller | 3,732,804 | Pobuda | 3,948,164 |

One known crushing apparatus flattens the can in a plane parallel with the longitudinal axis of the can, sometimes after a step in which the ends of the can are skewed and collapsed inwardly. This type of apparatus has the disadvantage of not reducing the bulk of the can as completely as possible.

Another known apparatus collapses the sides of the can in the approximate center of the longitudinal axis of the can so that the can ends are drawn toward the collapsed side. The can ends are then flattened to a plane parallel with the previsouly flattened can sides. This type of apparatus also has the disadvantage of not reducing the can's bulk to a minimum.

Finally, there are can crushers which crush the can along its longitudinal axis to bring the ends together. These devices alternatively gouge, split, or tear the can's sides to reduce the force needed to crush a can along the longitudinal axis. A disadvantage of one form of these crushers is that separate complex linkages are used to gouge or dent the sides before longitudinal axial compression can take place. A disadvantage of another style of apparatus is that a relatively strong force, separate from that force used for crushing the can, is needed to split or tear the can's sides by means of the sharp hooks or blades provided with the apparatus.

SUMMARY OF THE INVENTION

This invention is a unique device for crushing a can along its longitudinal axis into a configuration of minimum bulk. The arcuate movement of crush heads which are attached to and motivated by lever arms results in the buckling of the can's sides. This buckling reduces the force needed on the lever arms for crushing the can.

More specifically, this invention is an apparatus for the two-stage axial crushing of a can. This axial crushing is accomplished by moving first and second crush heads in successive first and second steps toward a horizontal base holding the can. The first and second crush heads are pivotally mounted to and moved baseward by respective long and short lever arms.

The short lever arm is pivotally mounted to a stanchion between the pivotal mount of the long lever arm and the horizontal base, and the length of the short lever arm is such that the short lever arm and second crush head do not interfere with the baseward movement of the first crush head and long lever arm. First and second links are pivotally mounted endwise to both the respective first and second crush heads and the stanchion. By means of the first and second links, forming a pantograph like structure the first and second crush heads are maintained with the faces thereof in a plane substantially parallel to the base; however, the angular relationship thereof may be altered to impose an initial crushing force upon one zone of the can end to facilitate crushing. The long and short lever arms are joined by a lever link which is pivotally mounted to both the long and short lever arms. If this lever link is pivotally mounted to both lever arms on that side of the stanchion with the crush heads, the link will function as a compression link, moving the second crush head baseward in concert with the first crush head. If this lever link is pivotally mounted to both lever arms on that side of the stanchion opposite the side having the crush heads, the link will function as a tension link in moving the second crush head baseward in concert with the first crush head.

In an alternative version of the invention, an elbow joint forming a toggle linkage on the side of the stanchion opposite the crush heads links a first elbow arm pivotally attached to the long lever arm and a second elbow arm pivotally attached to the horizontal base. An elbow actuator arm is pivotally mounted at the elbow joint of the first and second elbow arms and also pivotally attached to the short lever arm. Baseward movement of the long lever arm on the side of the stanchion with the first and second crush heads thereby causes the long lever arm to pull on the first elbow arm and elbow joint, causing the second elbow arm to rotate about its pivot on the base and causing the elbow actuator arm to be moved according to the movement of the elbow joint. The straight line motion of the long lever arm is thus transferred into a rotative motion of the second elbow arm and the force multiplication as finally realized in the elbow actuator arm, the short lever arm and second crush head, greatly facilitates the crushing of cans beneath the second crush head with an increasingly higher degree of force multiplication as the second crush head approaches the base.

These aforementioned embodiments of the apparatus may also include a stanchion which is substantially angled with respect to the base so that the force multiplication of the lever link in compression is fully realized by pivotally mounting the lever link in close proximity to the stanchion on the first lever arm and pivotally mounting the lever link on the second lever arm as far as possible from the second arm's stanchion pivot.

In any of the abovementioned embodiments, the method of can crushing is the same. The can to be crushed is first placed upon the horizontal base between the base and first crush head. The long lever arm is moved baseward so that the first crush head meets the top of the can and the can is partially axially crushed. An optional stress rise means, such as a protruding lip, adpated to engage the top side of the can at one point on its periphery may be used to focus the stress initially at one point on the can to facilitate the initial collapse of the can. The movement of the first crush head toward the base is arcuate about the long lever arm's pivotal mount on the stanchion. This arcuate movement displaces the top of the can from the can's original axis so that the can's sides buckle. Thus the force needed to axially crush the can is thus greatly reduced. The partially crushed can is then moved beneath the second crush head and the long lever arm on the side of the stanchion with the crush heads is once again moved baseward. The second crush head is moved baseward by means of the short lever arm's link to the long lever arm and axial crushing of the can is completed. This two-step crushing may be done manually or by means of a hydraulic actuator.

DETAILED DESCRIPTION OF THE DRAWINGS

Referring specifically to the drawings, wherein like numerals indicate like parts, there are seen the various embodiments of this invention, described to make their construction and operation readily apparent.

Figure 1:
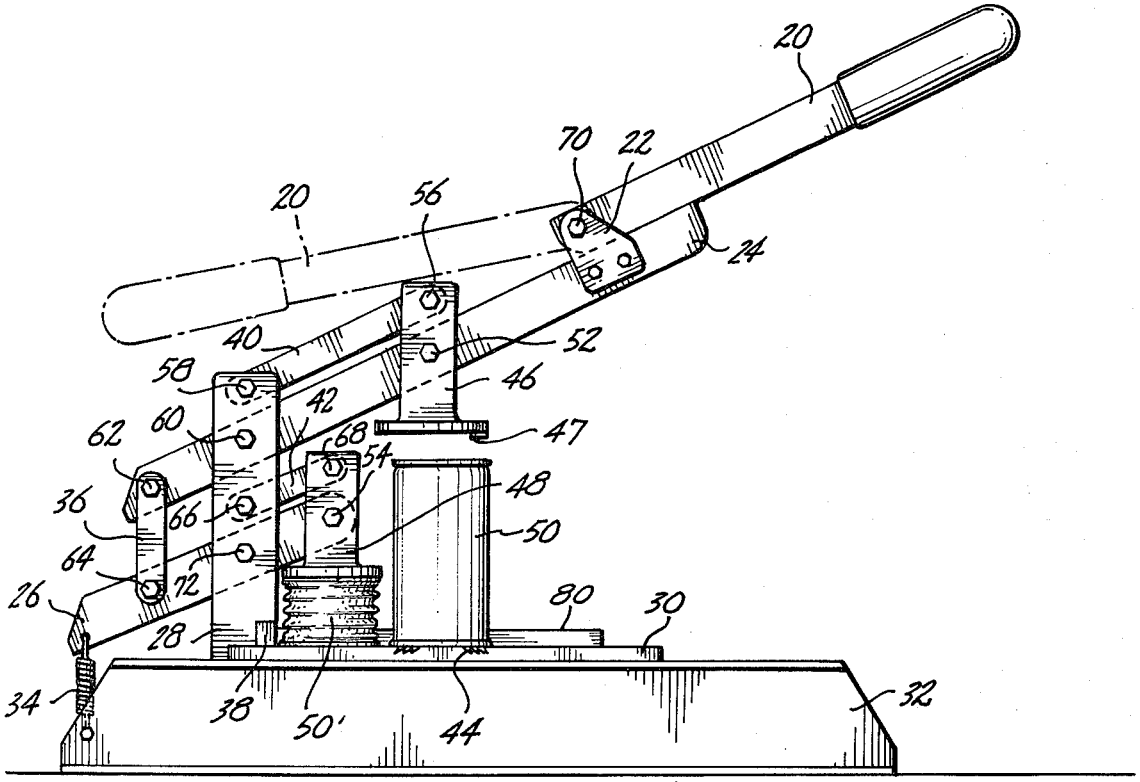
FIG. 1 is a side elevational view of the device of this invention with the long and short lever arms in an upraised position.
Figure 2:
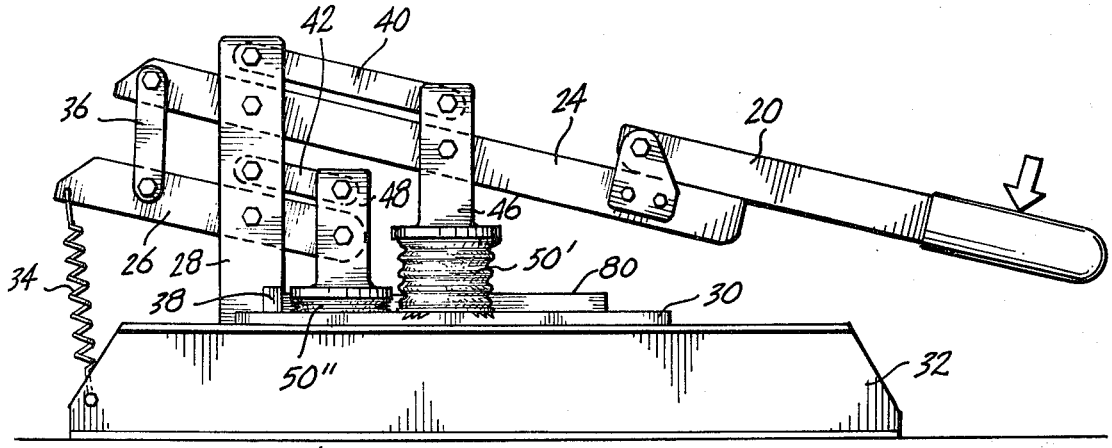
FIG. 2 is a side elevational view of the invention showing the long and short lever arms moved to their most baseward positon.

The embodiment shown in FIGS. 1 and 2 has a stanchion 28 fixed to a horizontal base 32, a pivot 60 rotatively attaching a long lever arm 24 on stanchion 28 and pivot 72 rotatively attaching short lever arm 26 between long lever arm 24 and base 32. Pivot 52 and pivot 54 rotatively attach lever arms 24 and 26 respectively to crush heads 46 and 48 respectively.

A first link 40 is rotatively attached by pivot 58 to stanchion 28 and rotatively attached by pivot 56 to crush head 46. This first link 40 maintains first crush head 46 in a can crushing attitude relative to base 32 during movement of crush head 46 toward base 32. The second link 42 rotatively attached at pivot 66 to stanchion 28 and rotatively attached at pivot 68 to second crush head 48 keeps second crush head 48 in a can crushing attitude relative to base 32 during the movement of crush head 48 toward base 32.

The long lever arm 24 and short lever arm 26 are joined by a lever link 36 which is rotatively attached at pivot 62 to the long lever arm 24 and rotatively attached at pivot 64 to the short lever arm 26. Spring 34 urges the apparatus into the open position shown in FIG. 1.

To begin the first stage of can crushing, the can crusher operator first rotates handle 20 from its position shown in dotted lines in FIG. 1 to the position shown in full lines in FIG. 1 by pivoting handle 20 about pivot 70. A can 50 is then placed on the base plate 30 beneath the first crush head 46. The operator moves the handle 20 and long lever arm 24 toward the base 32 so that the first crush head 46 contacts the top of the can. A stress riser 47 is located on the baseward side of crush head 46. Stress riser 47 can be of various shapes and thicknesses such that it causes a portion of the side of can 50 to buckle as stress riser 47 engages the top of can 50 prior to engagement of crush head 56. The preferred embodiment of stress riser 47 is an elongated flat ridge extending along a short portion of the periphery of crush head 56. This buckling displaces the sides of the can 50 so that the force needed to axially crush the can is significantly reduced. The long lever arm 24 is moved toward the base 32 to the position shown in FIG. 2. The extreme baseward positions of the first and second crush heads 46 and 48 respectively are shown in FIG. 2. The can 50 has been collapsed to the can 50'.

In the second stage of can crushing the partially collapsed can 50' is moved on base plate 30 to rest directly beneath the second crush head 48. Once again the operator moves the handle 20 baseward or downwardly. The lever link 36 as pivotally attached at pivots 62 and 74 and linking the long and short lever arms 24 and 26 respectively causes the second crush head 26 to rotate about its stanchion pivot 72 and finish the crushing of the can. The extreme baseward position of the second crush head is shown in FIG. 2. The completely crushed can 50'' is then removed.

One feature of this invention is the arcuate movement of the first and second crush heads 46 and 48 respectively as shown in FIGS. 1 and 2. Pivot 52 rotatively attaching first crush head 46 to the long lever arm 24 defines an arc in its movement toward the base 32 as the lever arm 24 is moved toward base 32. This arcuate movement follows a circle of radius the length of which is the length of the lever arm 24 from pivot 60 to pivot 52. When the can 50 is placed on base plate 30 under the first crush head 46 and the crush head 46 is moved towards the base 32 by a force on the folding handle 20, the first crush head 46 moves in an arcuate fashion toward base 32, such that when the first crush head 46 has met the top of the can 50, the sides of the can 50 are first buckled and the force needed to axially crush the can is thereby substantially reduced. The buckling of the can's 50 sides caused by the arcuate movement of the crush head can be increased with the addition of a stress riser, 47, such as that shown in FIG. 1. The stress riser 47 concentrates the initial crushing force of the crush head 46, thereby buckling a portion of the can's 50 side before the crush head 46 comes into full contact with the can 50.

To properly position the can 50 under first crush head 46 there is a guideway 80 attached to base plate 30. Can 50 is properly positioned if it abutts guideway 80. Guideway 80 extends along base plate 30 to also position can 50' under second crush head 48. Can 50' is also positioned by guide means 38. Guide means 38 is constructed by providing an angular relief in stanchion 28 and serves to help remove can 50'' by diverting it off to the side of base 32 when pushed upon by another can 50'.

Figure 3:
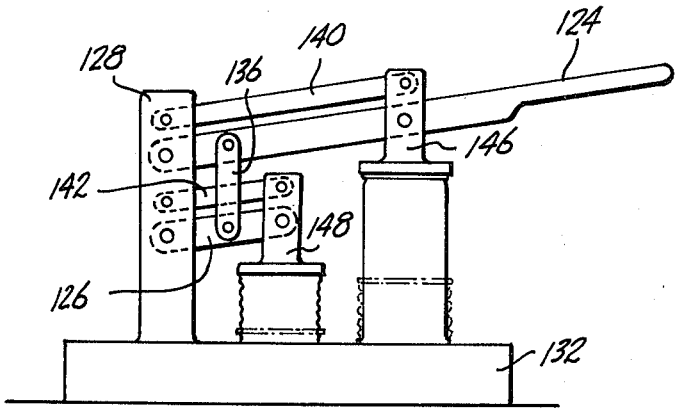
FIG. 3 is a side elevational view of a second embodiment of the invention, having a compression lever link for the long and short lever arms.
Figure 4:
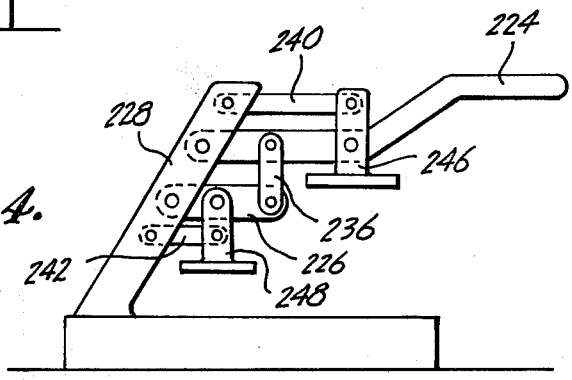
FIG. 4 is a side elevational view of a third embodiment of this invention also having a compression lever link.
Figure 5:
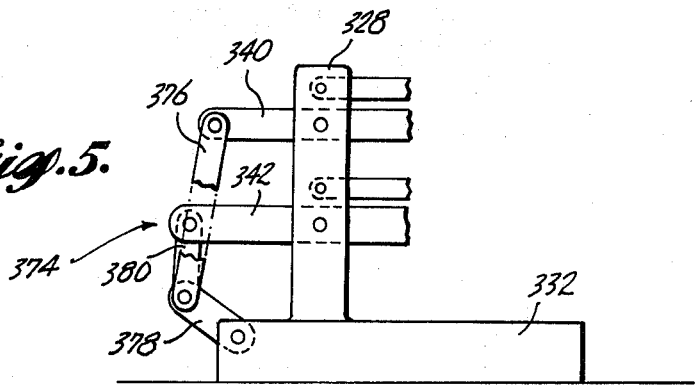
FIG. 5 is a side elevational view of a fourth embodiment of this invention having a toggle-type elbow joint link between the long and short lever arms.

Alternative methods of linkages providing force multiplication between the lever arms are shown in the embodiments of FIGS. 3, 4 and 5. In FIG. 3 the long lever arm 124 and short lever arm 126 are pivotally attached to the stanchion 128 but extend from the stanchion 128 on one side only. First and second crush heads 146 and 148 are pivotally attached to the long and short lever arms 124 and 126 respectively and first and second links 140 and 142 are pivotally attached to the stanchion 128 and pivotally attached to their respective crush heads 146 and 148. The lever link 136 acts in compression. That is, when long lever arm 124 of FIG. 3 is moved toward base 132, lever link 136 is compressed between long lever arm 124 and short lever arm 126 and short lever arm 126 is thus moved toward base 132.

Another embodiment having a compression lever linkage between the longer and shorter lever arms is shown in FIG. 4. Long arm 224 and short lever arm 226 are shown pivotally attached to a stanchion 228. Stanchion 228 is canted or angled with respect to base 232 to enhance the force multiplicaton of forces applied to short lever arm 226.

Pivotally attached to the long and short lever arm 224 and 226 are first and second crush heads 246 and 248. Pivotally attached to both first and second crush heads 246 and 248 and the stanchion 228 are first and second links 240 and 242 respectively. In this embodiment the stanchion 228 is angled with respect to the base 232 so that a compression link 236 between long lever arm 224 and short lever arm 226 may be pivotally mounted on long lever arm 224 as near as possible to stanchion 228 and pivotally mounted on short lever arm 226 as far as possible from stanchion 228. Being mounted in this manner, the lever link 236 gives the short lever arm 226 and second crush head 248 a greater degree of force multiplication during movement of crush head 248 toward base 232.

Another embodiment of this invention is shown in FIG. 5. In this embodiment long lever arm 340 and short lever arm 342 are pivotally attached to the stanchion 328 and extend outwardly from both sides of stanchion 328 so that a lever link 374 extends therebetween in tension during a can crushing stroke. The lever link 374 consists of a first elbow arm 376 pivotally attached to a second elbow arm 378 which is in turn pivotally attached to the base 332. An elbow actuator arm 380 is pivotally attached to the pivot of first and second elbow arms 376 and 378 and the elbow actuator arm 380 is in turn pivotally attached to the short lever arm 342. Downward motion of the long lever arm 340 on the side of the stanchion 328 opposite that side with the lever link 374 is such that the pivotally mounted first elbow arm 376 will cause the second elbow arm 378 to rotate about its pivotal attachment to the base 332 and the elbow actuator arm 380 will cause the short lever arm 342 on the side of the stanchion 328 opposite the lever link 374 to move toward base 332. The force multiplication resulting from the overcenter or toggle linkage shown applied to short lever arm 342 by the rotation of the second elbow arm 378 about its pivotal attachment to the base 332 is apparent.

Figure 6:
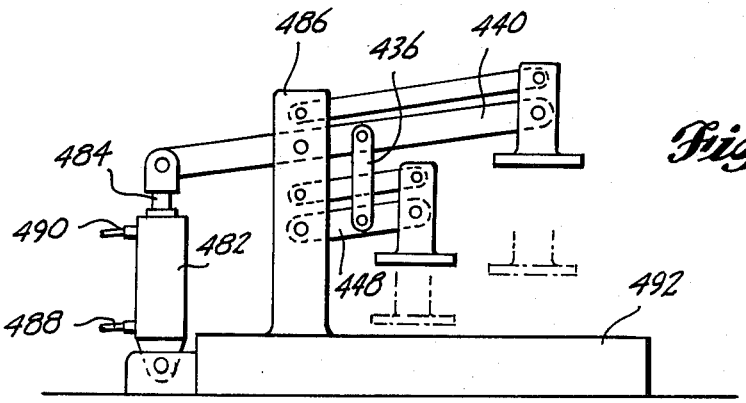
FIG. 6 is a side elevational view of a fifth embodiment of this invention showing an hydraulic cylinder actuator means.

One additional embodiment of the invention is shown in FIG. 6 in which a lever link 436 exists in compression between pivotal attachments to both a long lever arm 440 and a short lever arm 448. A hydraulic cylinder 482 pivotally attached to the long lever arm 440 on the side of the stanchion 486 opposite that side having the lever link 436, has a piston shaft 484 and ports 488 and 490. When it is desired to crush a can, hydraulic fluid is routed through the port 488. The shaft 484 will extend from the cylinder 482 and force the long and short lever arms 440 and 448 on that side of the stanchion with the lever link 436 toward the base 492. In this case port 490 will serve as an outlet. When it is desired to move or remove a can, port 490 can serve as an inlet to the cylinder 482 and port 488 can serve as an outlet to move the respective long and short lever arms 440 and 448 away from the base.

I claim:

1. A device for crushing a can along its longitudianl axis comprising:

means forming a horizontal base;

an upright stanchion mounted upon said base;

a long lever arm crossing said stanchion and being pivotally connected thereto;

a short lever arm crossing said stanchion and pivotally connected to said stanchion between said long lever arm and said base means;

a first crush head pivotally connected to said long lever arm and cooperating with said base upon rotation of said long lever arm toward said base to axially crush a cylindrical container placed between said crush head and said base;

a second crush head pivotally connected to said short lever arm and cooperating with said base upon rotation of said short lever arm toward said base to axially crush a cylindrical container placed between said crush head and said base;

a first link pivotally connected endwise between said first crush head and said stanchion;

a second link endwise pivotally connected between said second crush head and said stanchion; and linkage means interconnecting said long lever arm and short lever arm whereby rotation of said long lever arm about its pivotal mounting on said stanchion induces corresponding rotational movement of said short lever arm.

2. A device for crushing a can along its longitudinal axis comprising:

means forming a horizontal base;

an upright stanchion mounted upon said base;

a long lever arm pivotally connected to said stanchion, a short lever arm pivotally connected to said stanchion between said long lever arm and said base means;

a first crush head pivotally connected to said long lever arm and cooperating with said base upon rotation of said long lever arm toward said base to axially crush a cylindrical container placed between said crush head and said base;

a second crush head pivotally connected to said short lever arm and cooperating with said base upon rotation of said short lever arm toward said base to axially crush a cylindrical container placed between said crush head and said base;

a first link pivotally connected endwise between said first crush head and said stanchion;

a second link endwise pivotally connected between said second crush head and said stanchion;

linkage means interconnecting said long lever arm and said short lever arm whereby rotation of said long lever arm about its pivotal mounting on said stanchion induces corresponding rotational movement of said short lever arm.

3. The apparatus of claim 1 wherein said linkage means is positioned on said lever arms on the opposite side of said stanchion from said crush heads.

4. The apparatus of claims 1 or 2 wherein said linkage means is positioned on said lever arms on the same side of said stanchion with said crush heads.

5. The apparatus of claim 1 wherein said linkage means comprises an elbow joint pivotally connected endwise between said long lever arm and said base means on that side of said stanchion opposite said first and second crush heads, said elbow joint having an intermediate elbow pivot between said base means and said long lever arm, which elbow pivot is in turn pivotally connected by an elbow actuator arm to said short lever arm on the side of said stanchion opposite said first and second crush heads, whereby a can is placed between said first crush head and said base means and said long lever arm on the side opposite said elbow joint is moved toward said base means the can is partially axially crushed and when the can is thereafter placed between said second crush head and said base means and said long lever arm is once again moved toward the base said elbow joint moves away from said base means causing the pivotally connected elbow actuator arm to move away from said base means thereby causing said short lever arm to move toward the said base means on the crush head side, completing the axial crushing of the can.

6. The apparatus of claims 1 or 2 wherein said stanchion is mounted on said base at an angle.

7. The apparatus of claims 1 or 2 wherein said first crush head has a protrusion thereon which engages the top of the can providing a zone of stress concentration on the can to initiate crushing.

8. The apparatus of claims 1 or 2 wherein said first crush head and said second crush head are maintained in positions substantially parallel to said base means through the pivotal motion of said first link and said second link, respectively.

9. The device of claims 1 or 2 wherein said crush heads traverse an arcuate path when pivoted toward said base means.

10. The apparatus of claims 1 or 2 wherein said long and said short lever arms are interconnected so that they traverse equal angular displacements upon pivotal movement.

11. The device of claims 1 or 2 further comprising a spring linked to said base means and said short lever arm and biased to move said first and second crush heads away from said base.

12. The device of claims 1 or 2 further comprising a hydraulic actuating means providing the force needed to move said long lever arm.

13. The device of claims 1 or 2 wherein the long lever arm is hinged and folds upon itself when a force is applied to the distal end of the arm which is opposite that force needed to longitudinally compress cans by means of the long lever arm.

14. The device of claims 1 or 2 further comprising container guideways on said base means and guide means on said stanchion for positioning and removal of said container.

* * * * *